US007700047B2

(12) United States Patent
Quimby et al.

(10) Patent No.: US 7,700,047 B2
(45) Date of Patent: Apr. 20, 2010

(54) SYSTEM AND METHOD FOR TREATMENT OF HAZARDOUS MATERIALS, E.G., UNEXPLODED CHEMICAL WARFARE ORDINANCE

(75) Inventors: Jay M. Quimby, Parsippany, NJ (US); Richard A. Johnson, Herndon, VA (US); Alan T. Edwards, Portland, OR (US); John L. Donovan, Danvers, IL (US); McRea B. Willmert, Wilsonville, OR (US)

(73) Assignees: CH2M Hill Constructors, Inc., Englewood, CO (US); CH2M Demilitarization, Inc., Englewood, CO (US); CH2M Hill Engineers, Inc., Englewood, CO (US)

( * ) Notice: Subject to any disclaimer, the term of this patent is extended or adjusted under 35 U.S.C. 154(b) by 0 days.

(21) Appl. No.: 11/758,828

(22) Filed: Jun. 6, 2007

(65) Prior Publication Data

US 2008/0089813 A1 Apr. 17, 2008

Related U.S. Application Data

(62) Division of application No. 10/821,020, filed on Apr. 7, 2004, now abandoned.

(60) Provisional application No. 60/468,437, filed on May 6, 2003.

(51) Int. Cl.

| | |
|---|---|
| ***G05D 16/00*** | (2006.01) |
| ***F01N 3/08*** | (2006.01) |
| ***F23G 7/00*** | (2006.01) |
| ***F23D 7/00*** | (2006.01) |

(52) U.S. Cl. ..... 422/112; 422/176; 110/237; 110/240; 110/241; 110/242; 110/235; 86/50

(58) Field of Classification Search ..... 422/112, 422/176; 110/237, 240, 241, 242, 345; 588/400, 588/403; 86/50

See application file for complete search history.

(56) References Cited

U.S. PATENT DOCUMENTS

| | | | |
|---|---|---|---|
| 2,789,076 | A | 4/1957 | Frieder et al. |
| 2,807,056 | A | 9/1957 | Vogt |

(Continued)

FOREIGN PATENT DOCUMENTS

| | | |
|---|---|---|
| EP | 0315616 | 5/1989 |

(Continued)

OTHER PUBLICATIONS

"Hot-Gas Decontamination", USAEC, Dec. 22, 2000, pp. 1-4 (http://web.archive.org/web/20010424050413/http://aec.army.mil/prod/usaec/et/restor/hotgas.htm).*

(Continued)

*Primary Examiner*—Walter D Griffin
*Assistant Examiner*—Lessanework Seifu
(74) *Attorney, Agent, or Firm*—Dorsey & Whitney LLP

(57) ABSTRACT

Systems and methods for treating hazardous materials are disclosed. One exemplary implementation provides a system for rendering chemical weapons materiel less hazardous. This system includes a detonation chamber, an expansion chamber, and an emission treater adapted to treat gas from detonation of the chemical weapons materiel. The emission treater yields a substantially dry residual waste stream and a treated gas suitable for venting to atmosphere. The emission treater may treat the gas with an alkaline powder that interacts with the gas, producing the residual waste stream.

22 Claims, 3 Drawing Sheets

U.S. PATENT DOCUMENTS 2,931,751 A 4/1960 Du Fresne
2,977,106 A 3/1961 Duff
3,032,835 A 5/1962 Saar et al.
3,150,618 A 9/1964 Rosenfeld
3,169,478 A 2/1965 Schaaf
3,192,098 A 6/1965 Phillips
3,239,092 A 3/1966 Levenetz
3,282,743 A 11/1966 Holtzman
3,408,432 A 10/1968 Tumm et al.
3,435,763 A 4/1969 Lavine
3,464,249 A 9/1969 Klein
3,485,075 A 12/1969 Kiselev et al.
3,611,766 A 10/1971 Klein et al.
3,629,021 A 12/1971 Lyerly
3,678,624 A 7/1972 Bicicchi
3,711,993 A 1/1973 Liesch et al.
3,721,201 A 3/1973 Boller
3,766,844 A 10/1973 Donnelly et al.
3,793,101 A 2/1974 Mullarkey
3,800,715 A 4/1974 Boller
3,800,716 A 4/1974 Berger
3,801,416 A 4/1974 Gulbierz
3,903,814 A 9/1975 Altekruse
3,910,084 A 10/1975 Paton et al.
3,915,104 A 10/1975 Hapgood et al.
4,013,190 A 3/1977 Wiggins et al.
4,027,601 A 6/1977 Hickerson
4,055,247 A 10/1977 Benedick et al.
4,079,612 A 3/1978 Smirnov et al.
4,081,982 A 4/1978 Minin et al.
4,085,883 A 4/1978 Deribas et al.
4,100,783 A 7/1978 Gambarov et al.
4,111,753 A 9/1978 Folsom et al.
4,149,649 A 4/1979 Szego
4,174,624 A 11/1979 Shrum
4,248,342 A 2/1981 King et al.
4,320,709 A 3/1982 Hladun
4,325,309 A 4/1982 King et al.
4,432,285 A 2/1984 Boyars et al.
4,478,126 A 10/1984 Holmlund et al.
4,478,350 A 10/1984 Ohlsson
4,545,286 A 10/1985 Fedij
4,574,105 A 3/1986 Donovan
4,621,559 A 11/1986 Ohlson et al.
4,632,041 A 12/1986 Ohlson
4,686,911 A 8/1987 Phillips
4,709,453 A 12/1987 Harvey et al.
4,727,789 A 3/1988 Katsanis et al.
4,781,145 A 11/1988 Amlinsky et al.
4,795,619 A 1/1989 Lerner
4,824,624 A 4/1989 Palicka et al.
4,836,079 A 6/1989 Barrett
4,862,804 A 9/1989 Chawla et al.
4,865,828 A * 9/1989 Lerner ..... 423/244.08
4,875,420 A * 10/1989 Hay et al. ..... 110/215
5,024,159 A 6/1991 Walley
5,044,252 A 9/1991 Gamadi et al.
5,149,911 A 9/1992 Ringbloom et al.
5,207,176 A 5/1993 Morhard et al.
5,233,932 A 8/1993 Robertson
5,248,055 A 9/1993 Sanai et al.
5,263,425 A 11/1993 Koenig
5,329,864 A 7/1994 Doring
5,331,106 A 7/1994 Spas
5,333,532 A 8/1994 Smirlock et al.
5,339,666 A 8/1994 Suzuki et al.
5,415,101 A 5/1995 Brinkmann
5,419,862 A 5/1995 Hampel
5,458,071 A 10/1995 Tadmor et al.
5,481,062 A * 1/1996 Lamnevik ..... 588/320
5,495,812 A 3/1996 Schulze
5,522,326 A 6/1996 Vollhardt
5,569,436 A 10/1996 Lerner
5,607,353 A 3/1997 Hutchings et al.
5,607,654 A * 3/1997 Lerner ..... 423/240 S
5,613,453 A 3/1997 Donovan
5,648,636 A 7/1997 Simpson et al.
5,649,324 A 7/1997 Fairweather et al.
5,668,342 A 9/1997 Discher
5,689,084 A 11/1997 Malotky et al.
5,711,706 A 1/1998 Griffin et al.
5,727,481 A 3/1998 Voorhees et al.
5,792,978 A 8/1998 Woodall, Jr. et al.
5,881,654 A 3/1999 Fleming et al.
5,884,569 A 3/1999 Donovan
5,884,709 A 3/1999 Evans et al.
5,970,841 A 10/1999 Trocino
5,998,691 A 12/1999 Abel et al.
6,080,906 A 6/2000 Johnson et al.
6,121,506 A 9/2000 Abel et al.
RE36,912 E 10/2000 Donovan
6,143,136 A 11/2000 Aulbaugh et al.
6,173,662 B1 1/2001 Donovan
6,196,107 B1 3/2001 Hoffman et al.
6,200,664 B1 3/2001 Figge et al.
6,260,464 B1 7/2001 Gorrell et al.
6,342,186 B1 1/2002 Wingfield, III et al.
6,352,040 B1 * 3/2002 Voorhees et al. ..... 110/237
6,354,181 B1 * 3/2002 Donovan ..... 86/50
6,386,110 B1 5/2002 Landman et al.
6,431,094 B1 * 8/2002 Gregg ..... 110/237
6,552,295 B2 4/2003 Markunas et al.
6,647,851 B2 11/2003 Donovan
6,705,242 B2 * 3/2004 Donovan ..... 110/341
6,759,564 B2 7/2004 Max et al.
6,958,428 B2 10/2005 Scott et al.
7,022,296 B1 4/2006 Khang et al.
7,418,895 B2 9/2008 Donovan et al.
2002/0156336 A1 10/2002 Pak
2003/0050524 A1 3/2003 Northcutt
2003/0126976 A1 7/2003 Donovan
2003/0129025 A1 7/2003 Donovan
2004/0186339 A1 9/2004 Galloway
2005/0192472 A1 9/2005 Quimby et al.
2005/0279204 A1 12/2005 Bishop et al.
2006/0084834 A1 4/2006 Adams

FOREIGN PATENT DOCUMENTS

FR 2558949 8/1985
FR 2608268 6/1988
GB 2279231 1/1995
WO WO 96/000880 1/1996
WO WO 01/048437 7/2001

OTHER PUBLICATIONS

International Search Report dated Aug. 3, 2006, PCT/US04/013980, 3 pages.

Serena, Joseph M., "Development of an On-Site Demolition Container for Unexploded Ordnance," presented at the Global Demilitarization Symposium and Exposition, May 13-17, 1996.

Static Kiln Technical Description. Dynasafe AB, 2 pages, accessed Jul. 12, 2004 <<http://www.dynasafe.se/pdf/Static%20Kiln%20Data%20Sheet.pdf>>.

Tschritter, Ken. "Explosive Destruction System." Sandia National Laboratories, 1998, pp. 1-12.

U.S. Environmental Protection Agency, "Contained Detonation System for Destroying UXO Containing Chemical Agents" [online], 2001 [retrieved on Sep. 9, 2002]; retrieved from the Internet<URL:http://www.Hnd.usace.army.mil/oew/forums/UXO01/twing.pdf>.

Notice of Abandonment issued Oct. 1, 2007, U.S. Appl. No. 10/821,200, 2 pages.

Office Action issued Mar. 6, 2007, U.S. Appl. No. 10/821,020, 16 pages.

Amendment dated Nov. 28, 2006, U.S. Appl. No. 10/821,020, 15 pages.

Office Action issued May 31, 2006, U.S. Appl. No. 10/821,020, 18 pages.

Response to Restriction Requirement dated Apr. 24, 2006, U.S. Appl. No. 10/821,020, 6 pages.

Restriction Requirement issued Jan. 27, 2006, U.S. Appl. No. 10/821,020, 7 pages.

U.S. Appl. No. 12/195,178, filed Aug. 20, 2008, John Donovan et al.

* cited by examiner

SYSTEM AND METHOD FOR TREATMENT OF HAZARDOUS MATERIALS, E.G., UNEXPLODED CHEMICAL WARFARE ORDINANCE

CROSS-REFERENCE TO RELATED APPLICATION

The present application is a Divisional of U.S. patent application Ser. No. 10/821,020, filed Apr. 7, 2004, which claims the benefit of U.S. Provisional Application No. 60/468,437, filed May 6, 2003, the disclosures of which are incorporated herein by reference in their entirety.

Aspects of this application are related to U.S. Pat. Nos. Re 36,912; 5,884,569; 6,173,662; 6,354,181; 6,647,851; and 6,705,242; and to co-pending U.S. application Ser. Nos. 09/683,492 and 09/683,494 (both filed 8 Jan. 2002) and co-pending U.S. application Ser. No. 10/744,703 filed on 23 Dec. 2003. The entirety of each of these patents and applications is incorporated herein by reference.

TECHNICAL FIELD

The present invention generally relates to systems for handling potentially hazardous materials, e.g., military grade weapons. Aspects of the invention have particular utility in connection with rendering chemical warfare materiel less hazardous.

BACKGROUND

Disposal of hazardous materials presents a significant environmental challenge. For some types of hazardous materials, commercially acceptable processes have been developed to render the materials less hazardous. Other hazardous materials still present a meaningful challenge. One such hazardous material is chemical warfare materiel, such as explosively configured chemical munitions, binary weapons, and the like. Chemical warfare materiel is typically deemed unsafe for transport, long-term storage, or simple disposal, e.g., in a landfill. The limitations on transporting chemical warfare materiel call for a transportable system that can be used safely to destroy chemical warfare materials.

An existing transportable Explosive Destruction System (EDS) has been developed with the support of U.S. DOE Contract No. DE-AC04-94AL85000. The EDS uses shaped charges to access the chemical agent and destroy the burster and then treats the residue in the chamber with large volumes of aqueous solutions. After two hours or more of reaction time, the resulting liquid is collected through a drain in the chamber by tilting the chamber at an angle. Though the wet chemical treatment method employed by the EDS reduces handling and transportation restrictions associated with the highly toxic starting materials, the method requires the use of liquid chemical solutions that are toxic, such as monoethanolamine, or corrosive, such as sodium hydroxide. The product of the EDS process is a hazardous liquid waste.

Some chemical warfare munitions have been decommissioned using large rotary kilns or the like operating at very high temperatures (e.g., 1,500-2,000° F. or higher) for an extended period. Such systems are large, essentially immobile installations. As a result, such an installation must be built on-site wherever chemical warfare materiel is located or the materiel must be transported to the facility. Neither of these options is desirable. In addition, such kilns generally require that munitions be deactivated before being introduced. Although they may be designed to withstand blasts from an occasional unexploded munition, they are not built to withstand the rigors of repeated explosions resulting from treating large numbers of unexploded munitions.

DETAILED DESCRIPTION

A. Overview

Figure 1:
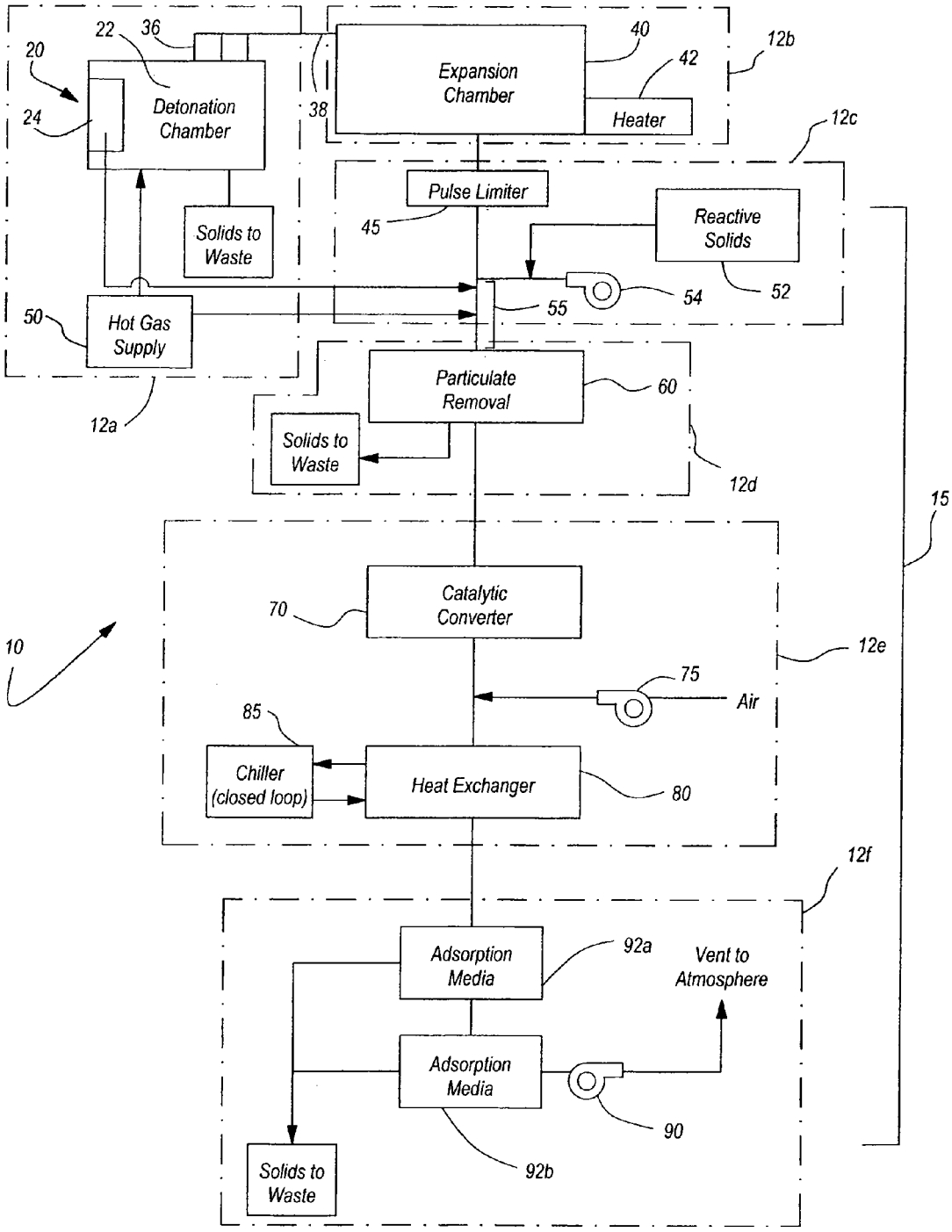
FIG. 1 is a schematic overview of a hazardous waste treatment system in accordance with one embodiment of the invention.

Various embodiments of the present invention provide systems and methods for treating, and optimally substantially neutralizing, hazardous chemicals. The term "hazardous chemicals" may encompass a variety of materials, including chemical weapons materiel and hazardous industrial and specialty chemicals. Examples of chemical weapons materiel include the following chemical agents: pulmonary agents such as phosgene; vesicants and blood agents such as lewisite and hydrogen cyanide; blister agents such as sulfur mustard; G series nerve agents, e.g., tabun (GA), sarin (GB), soman (GD), and cyclohexyl methylphosphonofluoridate (GF); and V series nerve agents, e.g., O-ethyl S-diisopropylaminomethyl methylphosphonothiolate (VX). Hazardous specialty and industrial chemicals can take any of a wide variety of forms, including (by way of non-limiting example) industrial phosgene; arsenides such as diphenylchloroarsine (DA), phenyidichloroarsine (PD), and ethyldichloroarsine (ED); cyanates such as hydrogen cyanide (AC), cyanogen chloride (CK), bromobenzyl cyanide (CA); and a variety of other chemicals such as chlorine ($Cl_2$), chloropicrin/phosgene (PG), chloropicrin (PS), bromoacetone (BA), O-chlorobenzylidenemalononitrile (CS), chloroacetophenone (CN), chloroacetophenone in benzene and carbon tetrachloride (CNB), chloroacetophenone and chloropicrin in chloroform (CNS), tin tetrachloride/chloropicrin (NC), adamsite (DM), and 3-quinuclidinyl benzilate (BZ). Some military and law enforcement applications use smoke-producing compounds that generate an obscuring smoke when contacted with air; such smoke-producing compounds are also deemed hazardous chemicals in the present context even if they are non-toxic. "Hazardous materials" and "hazardous waste" include both hazardous chemicals themselves and materials that contain or are contaminated with hazardous chemicals. For example, outdated ordinance containing a chemical warfare agent may be deemed hazardous waste.

As used herein, "neutralizing" a hazardous material refers to rendering the hazardous material less toxic or less active as an environmental contaminant. Optimal neutralization in embodiments of the invention would yield a residual solid waste stream and a substantially inert emitted gas, e.g., a gas deemed safe for release to ambient atmosphere under United States Environmental Protection Agency regulations in effect on 1 Jan. 2003. The solid waste may still be classified as a hazardous material under relevant environmental regulations, but it desirably a) is less hazardous than the starting hazardous material being treated, b) has a substantially reduced volume in comparison to the starting hazardous material, and/or c) is better suited for long-term storage or disposal than the starting hazardous material.

One embodiment of the invention provides a system for rendering chemical weapons materiel less hazardous. This system may include a detonation chamber, an expansion chamber, and an emission treater. The emission treater is adapted to treat gas from detonation of the chemical weapons materiel, yielding a substantially dry residual waste stream and a treated gas suitable for venting to atmosphere.

Another embodiment of the invention provides a system for treating hazardous material. This system includes a detonation chamber, a gas treater, a gas flow path between the detonation chamber and the gas treater, and a pulse limiter. The pulse limiter is disposed in the gas flow path and defines a communication opening of varying size that limits gas flow along the gas flow path.

A method of treating hazardous material in accordance with another embodiment of the invention includes explosively detonating a package comprising a hazardous material in a detonation chamber. Detonating the package generates a gas, which may be delivered to a gas treater at a controlled flow rate. The flow rate is controlled with a pulse limiter that defines a communication opening having a restricted size correlated to a pressure pulse of the gas. The method also includes changing the size of the communication opening.

A method of treating hazardous materials in an alternative embodiment comprises explosively detonating a package comprising a hazardous material in a detonation chamber having an inner surface. Detonating the package generates a gas. At least a portion of the inner surface is at a temperature of at least about 120° F., e.g., at least about 140° F., prior to detonating the package. The gas is delivered to a gas treater.

Still another embodiment of the invention provides a system for treating hazardous materials that includes a detonation chamber, a gas treater, and a heater. The detonation chamber is configured to withstand repeated detonations of energetic material, e.g., a conformable, high-energy explosive. The detonation chamber also has an interior surface. The gas treater is in fluid communication with the detonation chamber. The heater is adapted to heat at least a portion of the interior surface of the detonation chamber between successive detonations of energetic material.

A method of treating hazardous materials in yet another embodiment involves loading a first package comprising a first hazardous material in a detonation chamber having an inner surface, explosively detonating the first package and generating a first gas, and delivering the first gas to a gas treater. A second package comprising a second hazardous material is loaded in the detonation chamber and explosively detonated, generating a second gas. The detonation chamber is maintained at a temperature of at least about 120° F. between detonating the first package and detonating the second package.

One other embodiment provides another method of treating hazardous materials. In this embodiment, a package comprising a hazardous material is explosively detonated in a detonation chamber. Detonating the package generates a gas, which is delivered to an expansion chamber. The gas is delivered from the expansion chamber to a reaction zone. The gas is contacted with a reactant in the reaction zone to interact with components of the gas. Interaction of the reactant and the components of the gas produces a byproduct. Particulate matter is removed from the gas; this particulate matter may include the byproduct. The gas is delivered to a catalytic converter after removing the particulate matter.

A further embodiment of the invention provides a system for treating hazardous materials that includes a detonation chamber, an expansion chamber, and an gas treatment system. The expansion chamber is in fluid communication with the detonation chamber to receive gas generated by a detonation in the detonation chamber. The gas treatment system is in fluid communication with the expansion chamber to receive the gas from the expansion chamber. The gas treatment system may include a gas conduit, a reactant supply, a filter, and a catalytic converter. The reactant supply is in communication with the gas conduit and a reactant from the reactant supply interacts with the gas from the expansion chamber to form a byproduct. The filter is positioned downstream of the reactant supply and is adapted to filter at least a portion of the byproduct from the gas. The catalytic converter is positioned downstream of the filter and is adapted to treat the filtered gas.

For ease of understanding, the following discussion is broken down into two areas of emphasis. The first section describes hazardous chemical neutralization systems in accordance with certain embodiments of the invention. The second section outlines methods of neutralizing hazardous chemicals in accordance with other embodiments of the invention.

B. Hazardous Chemical Neutralization Systems

FIG. 1 schematically illustrates a hazardous material treatment system in accordance with one embodiment of the invention. This hazardous material treatment system 10 generally includes a detonation chamber 20, an expansion chamber 40, and an emission treatment subsystem 15. Each of these elements is discussed in more detail below. Generally, though, some embodiments of the invention are designed for transport to facilitate setting up the system on-site where the hazardous materials reside, then breaking down and moving the system to a new work site when the job is finished.

In one implementation, the hazardous material treatment system 10 comprises a series of modules, each of which is configured for transport. The particular embodiment shown in FIG. 1 includes six modules 12*a-f*. The detonation chamber 20 may be in a first module 12*a*, the expansion chamber 40 may be in a second module 12*b*, and components of the emission treatment subsystem 15 may be broken down into four modules 12*c-f*. The particular grouping of components in one module 12 versus another is up to the user and any number of modules 12 may be employed. In one example, the system 10 includes four modules 12—one for the detonation chamber, one for the expansion chamber, and two for various components of the emission treatment subsystem 15.

Each of these modules 12 may be sized for movement using conventional modes of transport. For example, each of the modules 12 may be sized and configured so that it fits within the confines of a standard intermodal container, allowing the container to be moved by trailer, rail, ship, or air. This is particularly useful for systems to be deployed worldwide. In other embodiments, the modules 12 may be larger, e.g., the dimensions of a standard trailer in the United States.

1. Detonation and Expansion Chambers

Figure 2:
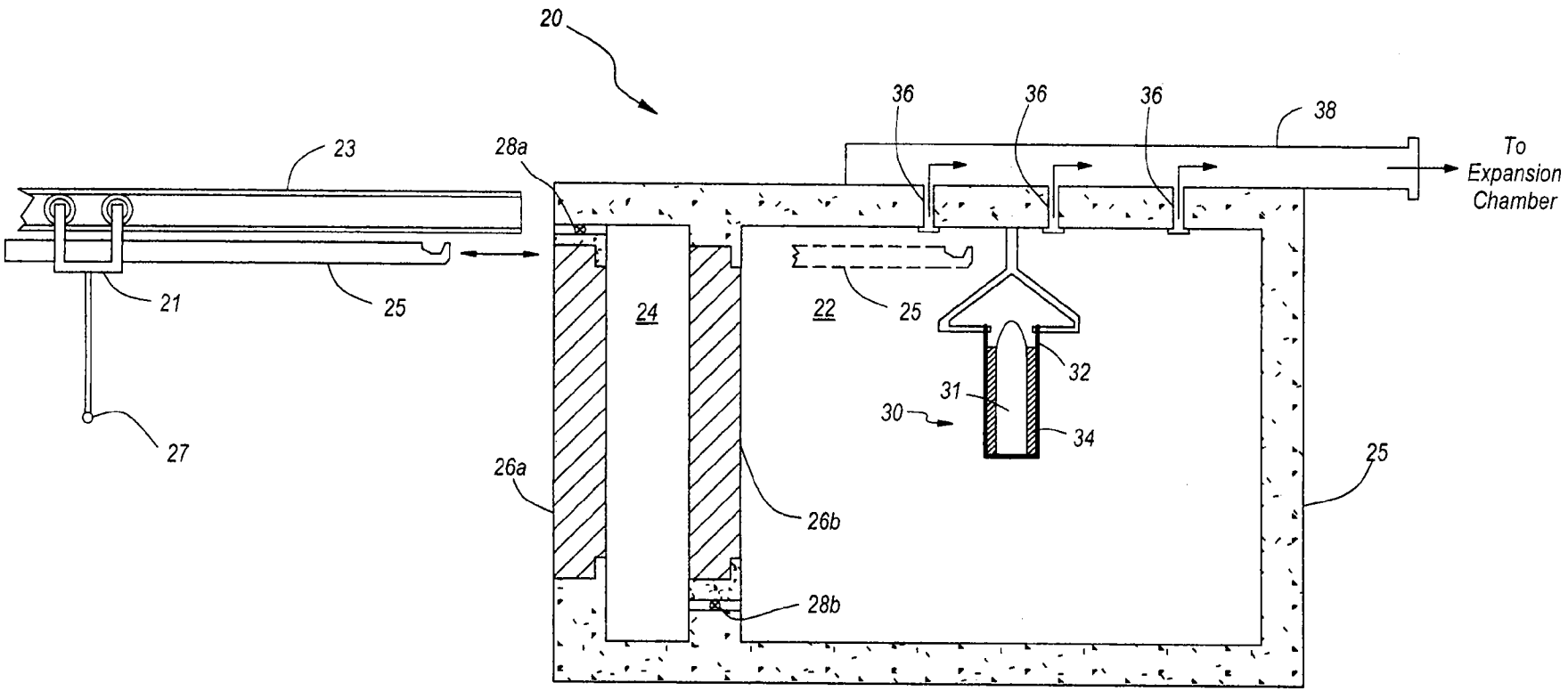
FIG. 2 is a schematic cross-sectional view of a detonation chamber in accordance with another embodiment of the invention.

As illustrated in FIG. 2, the detonation chamber 20 generally includes an inner chamber 22 in which the detonation takes place and an antechamber 24 that facilitates access to the inner chamber 22. The inner chamber 22 may be defined by walls 25 lined with a layer of shielding, e.g., armor such as that discussed in U.S. Patent Application Publication Nos. 2003/0126976 and 2003/0129025, the entirety of each of which is incorporated herein by reference. This defines an inner chamber volume that should be large enough to receive the reaction gases generated from detonation of the package 30 without developing undue pressure.

The antechamber 24 is defined between an outer door 26*a* and an inner door 26*b*. The inner door 26*b* may substantially seal an opening between the inner chamber 22 and the antechamber 24 and the outer door 26*a* may substantially seal an opening between the antechamber 24 and the space outside the detonation chamber 20. Air may be passed through the antechamber 24, e.g., by entering the antechamber 24 through an outer air inlet 28*a* and passing into the inner chamber 22 through an inner air inlet 28*b*. Ventilation between the doors 26 may be at a flow rate sufficient to clear effectively any toxins that inadvertently enter the antechamber 24 from the inner chamber 22. The ventilation gas may flow into the inner chamber 22 and thence through the remainder of the system 10. In the embodiment shown in FIG. 1, though, the ventilation gas is delivered directly from the antechamber 24 to the emission treatment subsystem 15.

FIG. 2 also schematically illustrates a package 30 positioned in the inner chamber 22 for detonation. This package 30 may comprise a container 31 of hazardous material and a shaped donor charge 34 suspended in a carrier 32. As discussed in U.S. Pat. No. 6,647,851 (incorporated by reference above), the donor charge 34 may be made of an energetic material, e.g., a highly energetic explosive, adapted to limit the impact of shrapnel on the walls 25. Detonation of the package 30 may be initiated by a detonator coupled to the donor charge 34. As discussed below, it may be useful to include an oxidizing agent (shown schematically as a pressurized oxygen canister) to complete oxidation of the material in the container 31 upon detonation. In some limited circumstances, it may also be useful to add additional fuel (shown schematically as a propane tank, though other fuels could be used instead) to generate more heat during the detonation and help break down the hazardous material in the package.

In one optional embodiment, containers of water (not shown) may be included in the inner chamber 22. As explained in U.S. Pat. Re. 36,912 (incorporated by reference above), this can help absorb energy from the detonation. This can help the chamber cool more quickly to a temperature that allows a worker to enter the chamber after detonation. In some particularly useful embodiments, a mechanical loader, typified as a loading arm 25 in FIG. 2, is used to position the package 30 in the inner chamber 22, so this is less of a concern. Containers of water, however, may be useful in neutralizing some hazardous chemicals, e.g., phosgene. If so desired, the containers of water may be included in the inner chamber 22 only if the addition of water would materially benefit neutralization of the hazardous material.

The mechanical loader shown in FIG. 2 includes a loading arm 25 attached to a carriage 21 that rides along an overhead track 23. The carriage 21 may include a manually graspable handle 27 positioned for a user to grasp and move the carriage 21 along the track 23. The loading arm 25 can be moved longitudinally between a rearward position (shown in solid lines) and a forward position (partially illustrated in dashed lines). In the rearward position, the loading arm is outside the detonation chamber 20. In its forward position, the loading arm 25 extends through the antechamber 24 and into the inner chamber 22 so it can move the carrier 32 into position.

The reaction gases in the inner chamber 22 may exit the detonation chamber 20 via one or more exhaust lines 36. If a plurality of exhaust lines 36 are employed, these exhaust lines 36 may communicate with a common exhaust manifold 38.

Turning back to FIG. 1, the exhaust manifold 38 communicates reaction gases from the detonation chamber 20 to the expansion chamber 40. The expansion chamber 40 helps dampen the surge of hot, high-velocity gases exiting the detonation chamber 20. The expansion chamber 40 may be any suitably sized vessel adapted to withstand the anticipated pressures of use. In one useful embodiment, the expansion chamber 40 may include a heater 42, shown schematically in FIG. 1. The heater 42 may comprise one or more electrical resistance heaters carried on the outside of the chamber 40, though other alternatives may be used instead.

The relative volumes of the expansion chamber 40 and inner chamber 22 of the detonation chamber 20 may be varied to meet the requirements of any particular application. Generally, though, the expansion chamber 40 will be larger than the inner chamber 22 of the detonation chamber 20. In one particular embodiment, the volume of the expansion chamber 40 is at least about two times, e.g., about five times, the volume of the inner chamber 22 of the detonation chamber 20.

Detonation of the material in the detonation chamber 20 will generate a substantial volume of reaction gases in a short period, causing a pulse of high pressure. Even with the addition of the expansion chamber 40, a substantial pressure pulse would be directed from the expansion chamber 40 along a flow path into the emission treatment subsystem 15. This, in turn, would drive the gas through the emission treatment subsystem 15 at a high velocity. Some elements of the emission treatment subsystem 15 may have an optimum operational range of flow rates. Allowing high velocity gas from the expansion chamber 40 to enter the emission treatment subsystem 15 may degrade its effectiveness. Pressure pulses generated from detonation of larger or more reactive loads in the detonation chamber 20 can even damage elements of the emission treatment subsystem 15.

In the embodiment shown in FIG. 1, a pulse limiter 45 is disposed between the expansion chamber 40 and the emission treatment subsystem 15. The pulse limiter 45 is adapted to limit the maximum velocity of gas entering the emission treatment subsystem 15. In some useful embodiments, the pulse limiter defines a communication opening having a size that can be changed over time.

For example, the pulse limiter 45 may comprise a series of interchangeable plates (not shown), e.g., steel plates, each of which has a differently sized orifice therethrough. As discussed below, the volume of gas generated by a detonation can be predicted with reasonable accuracy once the composition and volume of the material placed in the detonation chamber 20 is known. By positioning a steel plate having an orifice of appropriate size in the flow path between the expansion chamber 40 and the emission treatment subsystem 15, the maximum velocity of the gas entering the emission treatment subsystem 15 can be held at or below a predefined maximum velocity. If the orifice in the steel plate used for one detonation is not sized appropriately for the anticipated pressure pulse from a subsequent detonation, the steel plate in the pulse limiter 45 may be swapped out for a different steel plate having an appropriate orifice size.

The size of the orifice in any given steel plate in such an embodiment is static, i.e., the size of the communication opening does not change over time. The orifice will limit the velocity of gas entering the emission treatment subsystem 15 after the detonation. The velocity of gas passing through the orifice will decrease as the pressure in the expansion chamber 40 drops, though. As a result, the flow rate at lower pressures may be substantially lower than the emission treatment subsystem 15 is adapted to process, leading to longer cycle times to complete processing the gas from each detonation.

In an alternative embodiment, the size of the communication opening in the pulse limiter 45 may be varied to better optimize the velocity of gas entering the emission treatment subsystem 15 as the initial pressure pulse dissipates. In one particular embodiment, the pulse limiter 45 may comprise a control valve (not shown) that can be moved between an open position and a flow-restricting position. In its open position, the control valve may be sized to yield appropriate flow rates during normal operations, i.e., during times other than those in which the pressure just upstream of the pulse limiter 45 exceeds a certain maximum as a result of a detonation. Just prior to detonation, the control valve may be moved into its flow-restricting position, in which the communication opening is sized to limit the velocity of gases entering the emission treatment subsystem 15 to no greater than a predetermined maximum velocity deemed appropriate for the emission treatment subsystem 15. The size of the communication opening in the flow-limiting position may be determined based on the expected peak quasi-static pressure in the expansion chamber 40 as a result of the impending detonation. As the pressure in the expansion chamber 40 drops from the initial pressure pulse, the control valve may be moved toward its open position. This may be done gradually, e.g., under control of a computer (not shown) that monitors pressure in the expansion chamber 40 and optimizes the position of the control valve as the pressure changes.

In still another embodiment, the pulse limiter 45 includes a pair of control valves (not shown) arranged in parallel, with one (a damper) sized for the peak pressure upstream of the pulse limiter 45 and the second (a ventilation valve) sized for the desired flow rate closer to atmospheric pressure. The damper has a smaller communication opening adapted to control the flow rate of reaction gas into the emission treatment subsystem 15 at the initial high pressures following a detonation. After this initial pressure pulse has dropped to an acceptable level, the damper is closed and the ventilation valve is opened. The ventilation valve has a larger maximum communication opening to allow the reaction gas, now at a lower pressure, to flow into the emission treatment subsystem 15 at a higher rate. By appropriate control of the control valves, the velocity of the gas entering the emission treatment subsystem 15 can be maintained in an optimum range for the emission treatment subsystem 15 over a relatively wide range of upstream pressures. This will both enhance effectiveness of the emission treatment subsystem 15 and reduce the cycle time needed to vent the gases from a given detonation.

Figure 3:
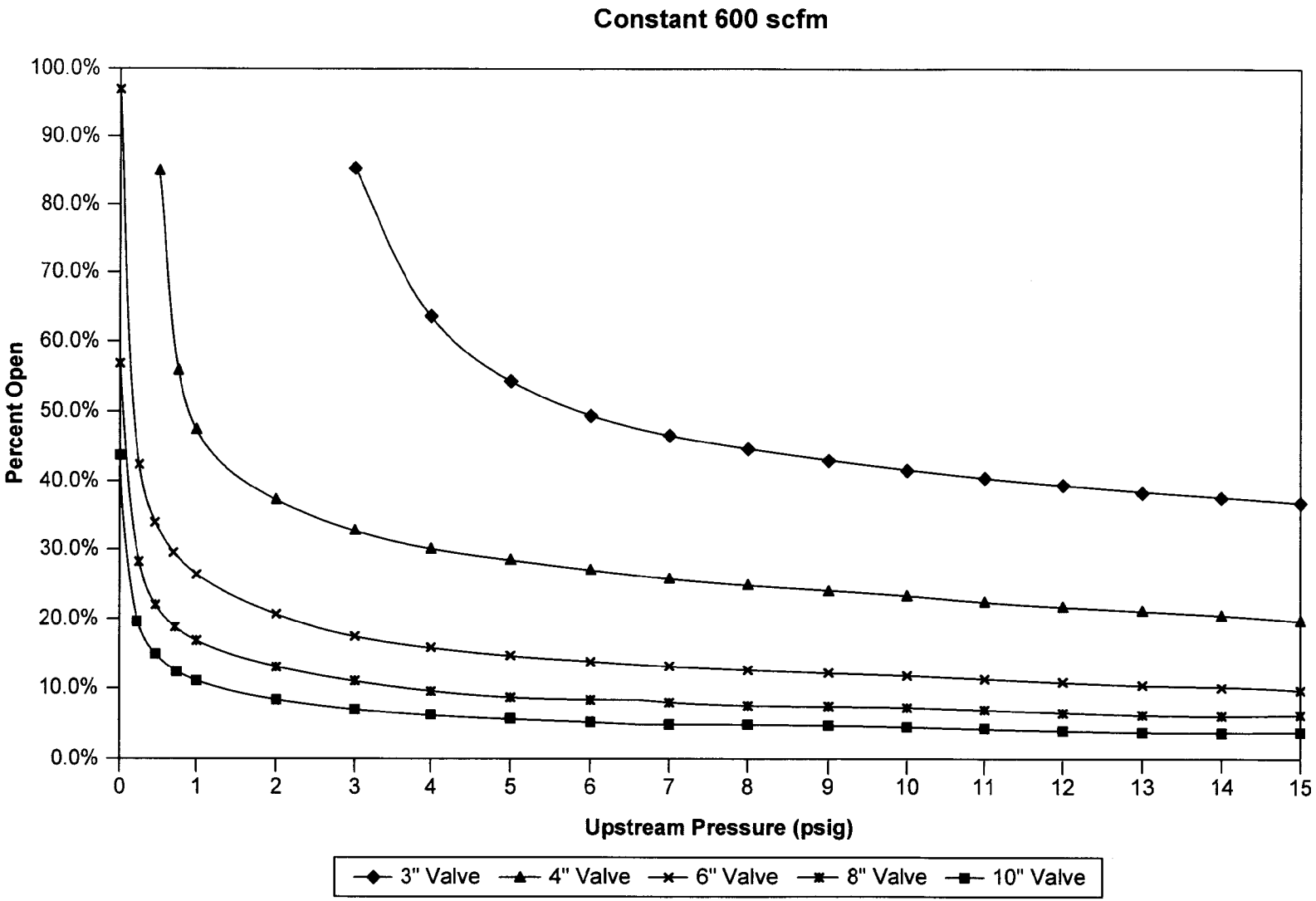
FIG. 3 graphically illustrates aspects of operation of a pulse limiter in accordance with a further embodiment of the invention.

FIG. 3 represents the percent open position (pre-set) position of the smaller-orifice damper with respect to the peak pressure (quasi-static upstream pressure) in the expansion chamber 40 that will allow the desired flow rate of gas. Testing of this configuration has determined that at a peak quasi-static pressure of 10.2 psig in the expansion chamber 40, less than two minutes was required to safely depressurize the expansion chamber 40, allowing the larger ventilation valve to open and maintain the desired ventilation flow rate.

2. Emission Treatment Subsystem

As noted below, detonation of hazardous materials in accordance with many embodiments of the invention is effective at destroying greater than 98% of the hazardous chemical(s) of interest in a package 30. In some embodiments, detonation alone has been found sufficient to destroy over 99%, e.g., 99.5% or more, of the hazardous chemical(s) of interest. The reaction gases generated by detonation generally include a variety of acids and other environmental contaminants. For example, detonation of chemical weapons materiel may generate an exhaust gas that includes a remaining portion of the starting hazardous chemical(s), carbon monoxide, acidic gases (e.g., one or more of $SO_x$, HF, HCl, and $P_2O_5$), other miscellaneous gaseous compounds and vapors (e.g., various sulfides, chlorides, fluorides, nitrides, phosphatides, and volatile organics), and particulate matter (e.g., soot, metal or metal compounds, and minerals). The emission treatment subsystem 15 may be adapted to neutralize and/or remove most or all of these components from the exhaust gas before the gas is emitted to the atmosphere.

FIG. 1 schematically illustrates an emission treatment subsystem 15 in accordance with one particular embodiment of the invention. It should be understood that a number of the components of the illustrated emission treatment subsystem 15 are merely optional and may be included or omitted depending on the range of hazardous materials to be treated.

The emission treatment subsystem 15 generally includes a solids reaction segment (contained in the module 12*c* in FIG. 1), a particulate removal segment (contained in module 12*d*), and a gas cleaning segment (contained in modules 12*e* and *f*). The solids reaction segment includes a reactive solids supply 52, a reaction zone 55, and a means to introduce the reactive solids into the reaction zone 55. The reactive solid in the reactive solid supply may be any single material or combination of materials that can effectively remove components of the exhaust gas entering the emission treatment subsystem 15. In one embodiment useful in neutralizing chemical weapons materiel, the reactive solids comprise an alkaline powder that can react with acid gases, adsorb solid metal fumes generated in the detonation process, and adsorb and react with reactive vapors that result from the detonation process. Suitable alkaline solids include, but are not limited to, crushed limestone, calcium carbonate, sodium bicarbonate, sodium carbonate, potassium bicarbonate, potassium carbonate, sodium hydroxide, potassium hydroxide, magnesium hydroxide, activated alumina (e.g., $Al(OH)_3$), and recovered salt from sea water. High-calcium hydrated lime has been found to work well. Sometimes mixtures of these alkaline solids may be employed. For example, hazardous materials including arsenides may be treated with a combination of high-calcium hydrated lime and activated alumina.

The reactive solids may be introduced to the exhaust gas in any suitable fashion. In the illustrated embodiment, a blower 54 is used to entrain solids from the reactive solids supply 52 in a conduit that is in communication with the flow of the exhaust gas. This entrained reactive solid will intermingle with the exhaust gas in the reaction zone 55.

The residence time and the temperature of the exhaust gas and reactive solids in the reaction zone 55 may be selected to optimize removal of undesirable components of the gas at an acceptable flow rate. In one embodiment, the exhaust gas contacts the reactive solids at a relatively high reaction temperature, preferably greater than about 350° F. To enhance the rate of reaction and removal of sulfur compounds, the gas in the reaction zone 55 may be at a temperature of about 600-1,200° F., e.g., about 800° F. This temperature can be controlled by adding heat to the exhaust gas. In the illustrated subsystem 15, the additional heat is provided by a hot gas supply 50 that delivers heated gas to or upstream of the reaction zone. A propane-fired heater heating ambient air has been found to work well, though other hot gas sources could be substituted. Alternatively, the reaction zone may be heated externally, e.g., by heating the walls of the reaction zone 55 with an electrical resistance heater The residence time of exhaust gas in the reaction zone 55 need not be very long. According to one embodiment, a reactor loop provides a residence time of approximately 0.5 seconds, where the reactive solids are in contact with the exhaust gas, prior to entering the particulate removal system.

Gas is delivered from the reaction zone 55 to the particulate removal system 60. The particulate removal system may comprise a HEPA filter, a centrifugal separator, or any other suitable means. If a filter is used, suitable filter media include ceramic fibers, rigid ceramic filter media, sintered metal, metallic cloth fiber, high temperature synthetic fibers, and metal membranes. In one particular embodiment, the particulate removal system comprises a number of candle filters (not shown). As is known in the art, such candle filters may comprise a tube, sealed at an end, made of porous ceramic or other material that has a defined pore size. This allows the exhaust gas to pass into the interior of the filter, yet traps the particulate material on the outside of the tube.

During operation, a layer of filter cake may build up on the exterior of the candle filters. passing the exhaust gas must pass through the filter cake increases the time for reaction between the reactive solids and the exhaust gas; in some embodiments, this reaction time may be substantially longer than the residence time in the reaction zone 55, e.g., 3-4 seconds of contact in the particulate removal system in comparison to a reaction zone residence time of about 0.5 seconds. Once the filter cake builds up to a thickness that reduces the flow through the particulate removal system 60 to an undesirable level, the filter cake can be blown off the filters by directing a reverse flow of gas, e.g., compressed dry air, into the centers of the candle filters. The filter cake can simply fall to the bottom of the particulate removal system 60 for safe disposal as a hazardous waste.

Exhaust gas exiting the particulate removal system 60 may be delivered to a catalytic converter 70. Any suitable commercially available catalytic converter can be used to convert remaining organic vapors and carbon monoxide into carbon dioxide and water. In one example, the catalytic converter comprised a precious metal catalyst on an alumina support. The catalytic converter 70 may be unnecessary when neutralizing some kinds of hazardous materials; its inclusion in the emission treatment subsystem 15 is entirely optional.

An air inlet 75 may be positioned downstream of the catalytic converter 70. In one embodiment, the air inlet 75 includes a damper that may be controlled to deliver a substantial volume of ambient air (e.g., a ratio of ambient air to exhaust gas of about 3:1) to cool the exhaust gas. The process fan 90 may be powerful enough to draw the ambient air into the emission treatment subsystem 15 (as well as draw the exhaust gas and a fairly continuous flow of cleansing air through the detonation chamber 90). Alternatively, the air inlet 75 may include a separate blower to drive air into the system, as well. In some methods of the invention, bags of water may be added to the detonation chamber 20 prior to detonation of a package 30 to help neutralize certain hazardous chemicals, e.g., phosgene, and/or to cool the detonation chamber 20. If substantial volumes of water are present in the exhaust gas, the introduction of cool ambient air can also reduce the relative humidity of the gas to limit condensation in downstream processes.

The emission treatment subsystem 15 of FIG. 1 also includes a heat exchanger 80. The heat exchanger 80 may be a closed-loop heat exchanger that employs water as a heat exchange medium and a chiller 85 to cool return water from the heat exchanger 80. In one embodiment, gas may enter the heat exchanger 80 at a temperature of about 400° F. and exit at a temperature of about 110° F.

After passing through the heat exchanger 80 (if employed), the exhaust gas may treated with an adsorption medium. If so desired, the exhaust gas may be further cooled and dehumidified by introducing ambient air downstream of the heat exchanger with an inlet fan 90. In the particular embodiment shown in FIG. 1, the emission treatment subsystem 15 includes two adsorption tanks 92*a* and *b* containing adsorption media. Suitable media include activated carbon, charcoal, and zeolite. In testing of some embodiments, the exhaust gas entering the adsorption media tanks 92 was suitable for emission to atmosphere, so the adsorption media may function as little more than a system redundancy.

C. Methods of Neutralizing Hazardous Materials

Other embodiments of the invention provide methods for neutralizing hazardous materials. For ease of understanding, the methods outlined below are discussed with reference to the hazardous chemical neutralization system 10 of FIGS. 1 and 2. The methods are not to be limited to any particular system illustrated in the drawings or detailed above, though; any apparatus that enables performance of a method of the invention may be used instead.

1. Neutralization of Hazardous Materials

To neutralize a hazardous material, a package 30 as described above may be packed and positioned in the inner chamber 22 of the detonation chamber 20. Although this can be done by a worker physically entering the inner chamber 22, the embodiment of FIG. 2 uses a loading arm 25 to position the package 30.

Knowing the nature and volume of the hazardous material to be treated allows estimation of the oxygen needed to effectively oxidize the package 30 and the volume of gases that will be created during detonation. For a hazardous chemical consisting primarily of carbon, hydrogen, sulfur, oxygen and phosphorous, for example, the reaction products from detonation should be $$C_xH_yS_zO_wP_v+(x+0.25y+z+1.25v-0.5w)O_2 \rightarrow xCO_2+0.5yH_20+zSO_2+0.5vP_20_5$$

wherein C is carbon and x is the number of carbon atoms in the molecule, H is hydrogen and y is the number of hydrogen atoms in the molecule, S is sulfur and z is the number of sulfur atoms in the molecule, O is oxygen and w is the number of oxygen atoms in the molecule, and P is phosphorous and v is the number of phosphorous atoms in the molecule.

If ambient air is used as the oxygen source in the detonation chamber 20, there will also be a volume of nitrogen in the inner chamber 22 that is about 3.8 times the requisite oxygen because air is about 21% oxygen and about 79% nitrogen. In another embodiment, the oxygen content in the inner chamber 22 of the detonation chamber 20 is increased above this 21% level, e.g., to at least about 25%. Supplemental oxygen can be added to the chamber 20 in a variety of ways. In one embodiment, the supplemental oxygen can be added by placing pressurized oxygen canister(s) in the inner chamber 22, as suggested in FIG. 2. These canisters can be provided with a line charge rigged to detonate at the same time as the donor charge 34 of the package 30, rapidly releasing the oxygen for reaction. In another embodiment, oxygen is delivered into the chamber as a free gas that displaces at least a portion of the air in the chamber 22. Alternatively, liquid oxygen can be delivered to the chamber 22. In still other embodiments, an oxygenating chemical (e.g., potassium permanganate) may be placed in the chamber 22 instead of delivering oxygen as a gas or liquid.

Although the reaction in the detonation chamber 20 may not proceed to stoichiometric completion (e.g., some of the carbon may form the monoxide instead of the dioxide), this formula allows one to approximate the number of moles of gas in the detonation chamber as a result of the detonation. Given the known volume of the detonation inner chamber 22 and the expansion chamber 40 and an estimated gas temperature, the pressure in the expansion chamber 40 just after detonation can be approximated. This approximation can then be used to set at least the initial size of the communication opening in the pulse limiter 45. In one embodiment discussed above, this can be accomplished by selecting a steel plate or the like having an orifice sized to allow a predetermined maximum flow rate of gas entering the emission treatment subsystem 15. In another embodiment discussed above, a valve can be set to define a suitably sized opening. After the initial pressure pulse wanes, the pulse limiter 45 can be adjusted to increase the size of the communication opening, maintaining a suitable gas flow rate over time.

As suggested above, the exhaust gas may then be treated with a reactive solid, e.g., an alkaline powder, in the reaction zone 55 and in a filter cake in the particulate removal system 60. The particles in the exhaust (both those present in the initial exhaust gas and those attributable to the addition of the reactive solid) can then be removed in the particulate removal system 60 and sent to a waste container at a suitable time. If the particulate removal system 60 employs a filter such as a candle filter, a reverse pulse of gas, e.g., compressed dry air, may be used to knock off built-up particles. This particulate residual waste may be substantially dry, with select embodiments yielding a waste with a moisture content of no greater than about 20 weight percent, e.g., about 15 weight percent or less.

The gas exiting the particulate removal system 60 may be subjected to one or more additional treatment steps, including cooling and dehumidification in the dehumidifier 65, catalytic treatment in the catalytic converter 70, cooling with the heat exchanger 80, and passing through an absorptive media in tanks 92.

Operation guidelines for most conventional detonation containment systems call for cooling to a temperature of 100° F. or less between detonations. This allows workers safely to enter the enclosure in which detonation is carried out to place a new charge of material in the enclosure for detonation. Waiting for the enclosure to cool to 100° F. increases cycle time and decreases system throughput, though.

Contrary to conventional wisdom, embodiments of the present invention maintain at least the interior surface of the detonation chamber's inner chamber 22 at an elevated temperature. This elevated temperature is desirably at least about 120° F., e.g., 140° F. or higher. Such high temperatures in the detonation chamber 20 could increase risk to workers entering the chamber. As mentioned above, though, one embodiment of the invention employs a loading arm 25 to load packages 30 into the detonation chamber. This reduces, and in some useful embodiments substantially eliminates, the time waiting for the detonation chamber 20 to cool before loading a new package 30.

In one particular implementation, the inner chamber 22 of the detonation chamber 20 is actively heated, e.g., by delivering heated gas from the hot gas supply 50 to the inner chamber 22. The same elements of the hot gas supply used for decontamination (discussed below) may be used to deliver heated air or other gases to the inner chamber 22. In another embodiment, the gas delivered to the inner chamber during normal operation is heated by a different heater than the one used during decontamination. The gas flow during decontamination may be heated by combustion (e.g., a propane-fired heater), but this can introduce unwanted moisture into the system 10. Using a separate electric heater to heat the gas delivered to the inner chamber 22 will avoid introducing additional moisture. In still other embodiments, the inner surfaces of the inner chamber 22 may be heated without adding heated gas, e.g., using a plenum within the wall of the inner chamber 22 or using electric resistance heating.

Actively heating the inner chamber 22 of the detonation chamber 20 is contrary to conventional wisdom for detonation containment systems, which dictates that the detonation enclosure must be allowed to cool. However, it has been found that maintaining the surfaces of the inner chamber 22 at a temperature of at least 120° F. or higher should improve efficiency and effectiveness of the system 10. Elevated-temperature operation not only avoids down time waiting for the chamber cool, but also drives up the temperature of the reactants during detonation, thereby promoting more complete oxidation of the hazardous chemical(s) in the package 30. Furthermore, may hazardous chemicals volatilize and/or break down at elevated temperatures. Maintaining the surface temperature in the inner chamber 22 at 120° F. or more will help drive off or break down any residual hazardous chemical(s) remaining on or that have seeped into those surfaces.

In another implementation, the expansion chamber 40 may be heated instead of or in addition to heating the inner chamber 22 of the detonation chamber 20. This may be accomplished by delivering heated air to the chamber 40 or, as mentioned above, by electrical resistance heating or the like. Many of the same benefits noted above from heating the detonation chamber 20 may also be achieved by heating the expansion chamber 40.

2. System Decontamination

From time to time, it may be necessary to decontaminate the hazardous material treatment system 10. For example, the system 10 should be decontaminated before it is disassembled for transport to another location or prior to opening any portion of the system, e.g. for maintenance or to remove waste solids.

Chemical decontamination or steam cleaning of equipment used for contained detonations is the current state-of-the-art. Such decontamination has shortcomings, though. The fluids commonly used in chemical decontamination do a poor job of penetrating cracks and crevices in surfaces that may contain traces of hazardous chemicals. Steam cleaning penetrates more effectively, but can still leave hazardous residue. In addition, chemical decontamination and steam cleaning typically require manual operators to clean the system, risking exposure to toxic chemicals.

Embodiments of the invention use heated air to decontaminate the hazardous material treatment system 10, including the detonation chamber 20, the expansion chamber 40, connecting gas conduits (e.g., exhaust manifold 38), and treatment equipment in the emission treatment subsystem 15. The system 10 should be heated to a temperature sufficient to break down residual hazardous chemicals and for a time that achieves a targeted level of decontamination. If so desired, the composition of the exhaust gas at a selected point in the emission treatment subsystem 15 may be monitored during decontamination and heating may continue until the treated gas is deemed sufficiently clean.

US government regulations define various levels of decontamination. One of the most rigorous of these standards, referred to as "5-X decontamination," requires that materials exposed to chemical warfare materiel be decontaminated by heating the exposed surfaces to at least 1,000° F. for a period of at least 15 minutes. Some components of the system 10 may not be well suited for such rigorous treatment, though. For example, the design criteria that allow the detonation chamber 20 to withstand repeated forceful detonations may make the use of materials capable of withstanding such decontamination impractical. It may be more practical to select components of the emission treatment subsystem 15 that can reliably handle 5-X decontamination. In one embodiment, the detonation chamber 20 and the emission treatment subsystem 15 are heated differently during decontamination, with the emission treatment subsystem 15 being heated to 1,000° F. for at least 15 minutes and the detonation chamber 20 being heated to a lower temperature, e.g., no higher than about 500° F. To achieve the desired degree of decontamination, it may be necessary to heat treat the detonation chamber for longer than the emission treatment subsystem 15 is heat treated. The expansion chamber 40 may be heated in tandem with the detonation chamber 20, or it, too, can be treated with 5-X decontamination.

The hot gas supply 50 may be sized to heat the interior surfaces of the system 10 to the desired temperature. In one implementation, the hot gas supply 50 includes two hot gas generators (not shown), e.g., propane-fired generators designed to heat ambient air. One of these hot gas generators can be used to heat the emission treatment subsystem 15 components to 1,000° F. or more and the other one can be used to heat the exposed surfaces of the detonation chamber 20 and expansion chamber 40 to a lower temperature, e.g., about 300-400° F. Each of these hot gas generators may be capable of delivering ambient airflow rates from 100 to 600 scfm and at temperatures of about 500 to 1,600° F.

The above-detailed embodiments and examples are intended to be illustrative, not exhaustive, and those skilled in the art will recognize that various equivalent modifications are possible within the scope of the invention. For example, whereas steps are presented in a given order, alternative embodiments may perform steps in a different order. The various embodiments described herein can be combined to provide further embodiments.

In general, the terms used in the following claims should not be construed to limit the invention to the specific embodiments disclosed in the specification unless the preceding description explicitly defines such terms. The inventors reserve the right to add additional claims after filing the application to pursue additional claim forms for other aspects of the invention.

We claim:

1. A mobile system for treating hazardous material, comprising:

a portable detonation chamber module including a detonation chamber therein configured for detonation of a selected hazardous item positioned therein;

a portable expansion chamber module including an expansion chamber therein spaced apart from the detonation chamber, the expansion chamber operatively associated with the detonation chamber to receive an exhaust gas from the detonation chamber;

a portable emission treater module coupled to the expansion chamber and configured for substantially dry treatment of the exhaust gas to produce a treated gas suitable for venting to atmosphere and a substantially dry residual waste stream without using a wet scrubbing process; and a pulse limiter positioned in a gas flow path between the expansion chamber module and the portable emission treater module, the pulse limiter defining a communication opening that controls pressure and velocity of the exhaust gas flowing to the portable emission treater module from the expansion chamber.

2. The system of claim 1 wherein the pulse limiter comprises a valve.

3. The system of claim 1 wherein the pulse limiter comprises a member including an orifice therethrough, the orifice having a size correlated to a pressure in the gas flow path downstream of the pulse limiter.

4. The system of claim 1 wherein the pulse limiter comprises a member including an orifice sized to limit flow of gas to the emission treater module to a predetermined maximum at an anticipated maximum pressure in the gas flow path upstream of the pulse limiter.

5. The system of claim 1 wherein the pulse limiter is adapted to change the size of the communication opening during a single detonation cycle.

6. The system of claim 1 wherein the pulse limiter is adapted to change the size of the communication opening as pressure upstream of the pulse limiter changes.

7. The system of claim 1 wherein the pulse limiter is adapted to change the size of the communication opening in response to a sensed pressure change.

8. The system of claim 1 wherein the communication opening has a first size during a first pressure phase and a second, larger size during a second pressure phase, the pressure in the first pressure phase being greater than the pressure in the second pressure phase.

9. The system of claim 1 wherein the detonation chamber includes an inner chamber and an antechamber that can be sealed from the inner chamber, the antechamber including an air inlet and an air outlet configured to flush gas in the antechamber.

10. The system of claim 1 wherein the emission treater module includes a conduit configured to introduce an alkaline powder into the exhaust gas being treated.

11. The system of claim 1 wherein the emission treater module includes a solids reactor and a catalytic converter, the solids reactor configured to introduce an alkaline solid into the exhaust gas being treated.

12. The system of claim 1 wherein the emission treater module includes a means for controllably cooling the exhaust gas from the detonation without introducing a liquid into the exhaust gas.

13. The system of claim 1 wherein the emission treater module includes a reactive solids conduit and a heated gas conduit, wherein the reactive solids conduit is configured to introduce an alkaline powder into the exhaust gas being treated and the heated gas conduit is configured to deliver heated gas to heat the exhaust gas in contact with the alkaline powder to a solids reaction temperature of at least about 600° F.

14. The system of claim 13 wherein the heated gas conduit is configured to deliver heated gas to heat the exhaust gas in contact with the alkaline powder to the solids reaction temperature of no greater than about 1,200° F.

15. The system of claim 1 wherein each of the detonation chamber module, the expansion chamber module and emission treater module are sized for transport as an intermodal container.

16. The system of claim 1 wherein the system is of modular construction and includes first, second, third, and fourth modules, the first module comprising the detonation chamber module, the second module comprising the expansion chamber module, and the third and fourth modules comprising modular sections of the emission treater module.

17. The system of claim 1 wherein the detonation chamber has an atmosphere comprising at least 25 weight percent oxygen and the system further comprises a detonation package in the detonation chamber, the detonation package including the selected hazardous item and a charge of energetic material.

18. The system of claim 1 further comprising a heater coupled to the detonation chamber and configured for heating an inner surface of the detonation chamber to a temperature of at least about 120° F. before detonation of the selected hazardous item.

19. The system of claim 18 wherein the heater is configured to heat the expansion chamber.

20. The system of claim 1 further comprising a first heater coupled to the detonation chamber for heating an inner surface of the detonation chamber to an operating temperature of about 120-300° F. before detonation of the selected hazardous item, and a second heater coupled to the detonation chamber for heating the inner surface to a higher decontamination temperature for use in periodically decontaminating the detonation chamber.

21. The system of claim 1 further comprising a mechanical loader operatively associated with the detonation chamber and configured to deliver the selected hazardous item to the detonation chamber.

22. The system of claim 1 further comprising an exhaust line extending between an exhaust outlet of the detonation chamber and an exhaust inlet of the expansion chamber, the exhaust line carrying the exhaust gas from the detonation chamber to the expansion chamber.

* * * * *